United States Patent [19]

Giesselmann et al.

[11] 4,044,701

[45] Aug. 30, 1977

[54] SEWING MACHINE FRAME WITH PRESSER FOOT AND NEEDLE BAR UNIT

[75] Inventors: Hannes Giesselmann; Karl Ingvar Fredrik Rendahl, both of Huskvarna, Sweden

[73] Assignee: Husqvarna Aktiebolag, Huskvarna, Sweden

[21] Appl. No.: 451,706

[22] Filed: Mar. 15, 1974

[30] Foreign Application Priority Data

| | | |
|---|---|---|
| Mar. 16, 1973 | Sweden | 7303690 |
| Mar. 16, 1973 | Sweden | 7303691 |
| Mar. 16, 1973 | Sweden | 7303692 |

[51] Int. Cl.[2] ..... D05B 73/02

[52] U.S. Cl. ..... 112/259

[58] Field of Search ..... 112/258, 259, 218

[56] References Cited

U.S. PATENT DOCUMENTS

| | | | |
|---|---|---|---|
| 1,902,605 | 3/1933 | Anderson | 112/258 |
| 1,928,486 | 9/1933 | Grunan | 112/258 |
| 2,497,651 | 2/1950 | Auslid | 112/258 |
| 3,025,812 | 3/1962 | Engel | 112/258 |
| 3,667,414 | 6/1972 | Illes | 112/254 |

*Primary Examiner*—George H. Krizmanich

*Attorney, Agent, or Firm*—Holman & Stern

[57] ABSTRACT

The present invention provides an improvement in assembling a sewing machine in which the machine has an open rear portion through which several units and devices in pre-assembled condition are mounted in the machine body and adjusted into proper positions during assembly.

5 Claims, 13 Drawing Figures

SEWING MACHINE FRAME WITH PRESSER FOOT AND NEEDLE BAR UNIT

FIELD OF THE INVENTION

The present invention relates to a sewing machine and a method for the assembling of the internal parts of a sewing machine in a shell-shaped body adapted to accomodate the parts in certain places.

BACKGROUND OF THE INVENTION

The assembling of a sewing machine is an extensive operation, since many of its parts have to be assembled with great precision, and the openings in the body are often very limited. One method to achieve a greater accessibility is to make the openings larger, but this means that the body obtained a nonuniform and irregular appearance and less stability. Many parts of the machines can be combined to larger units, which are then placed in prepared seats in the body. This method of assembly of the machine requires appreciably less work within the body itself and is also labor-saving as a whole. This method can be applied in particular to sewing machine bodies with fully open front or rear. The body thus open with its prepared or precast seats for journal bearings and points of attachment, presents a possibility for an automatic assembly of the previously assembled units entering into the machine. One advantage of this method is that the arm shafts which pass through both the top and the bottom arm of the body do not have to be threaded through their bearings, but are placed sideways into their bearing seats and are fixed by bearing holders. Moreover, the majority of settings and adjustments can be carried out during the assembling from the open side of the body. The stitch-forming elements, that is to say, the needle and shuttle in a sewing machine, must have a well adjusted position in relation to one another in order to achieve a perfect execution of the stitch formation. The same applies also to the presser foot and feeder. An improperly set presser foot gives rise to irregular feeding and consequently an uneven seam. A concentration of the elements to a unit provides a greater opportunity for introducing adjustment and setting elements into the mechanisms, than when each element is fixed separately in the body of the sewing machine. Assembled mechanisms also represent an advantage from a service point of view, since a fault located in such a unit can easily be remedied by substituting the unit in question.

OBJECTS AND SUMMARY OF THE INVENTION

It is an object of the invention to provide means for the simplification of the assembling, setting and adjustment of sewing machines, and such a simplification is achieved in accordance with the invention when the assembling is carried out in such a way that the presser bar, needle bar, thread tension, stitch length and top shaft units of the machine and the zigzag control, bottom arm shafts and shuttle mechanism in pre-assembled condition are placed and fastened in prepared or precast seats in a sewing machine body which is open on at least one side.

It is another object of the invention to provide a fixing and adjustment arrangement for a presser foot and needle bar unit which, by that means, becomes easy to assemble and to adjust in its position in the body of the sewing machine. The problem to achieve a simpler assembling of this unit solved in accordance with the invention in that the needle bar and presser foot are built up in a frame which, by means of given points of attachment, is flexibly adjustable in different directions and angles in the body of the sewing machine. The needle bar and presser foot mechanism are assembled in the frame outside the machine itself and are then placed together with the frame directly in position in the machine. Such an arrangement is characterized in that the unit is built up of an elongated frame with points of attachment at both ends, which points of attachment are shaped so that they provide a range of adjustment for the setting of the position of the unit in a sewing machine arm in at least one direction, mainly at a right angle to the longitudinal direction of the frame.

Since the attention to be given to the thread tension must be the greater, the more complicated the seams that are sewn, it makes sense to attach the same importance to the thread tension regulator as to other adjustment devices on an automatic zigzag sewing machine, that is to say, locate the regulator at a clearly visible place together with the other adjustment devices.

It is still another object of the present invention to provide a thread tensioning device which is well adapted to the outer contours of the sewing machine body and which can be controlled by means of a linkage and a regulator at a point which is separated from the thread tensioning device proper. By separating the actual regulator from the tensioner it is possible to extend the construction of the latter to comprise the whole thread guideway from the thread spool to the needle with the exception of the movable thread take-up lever. The advantages of a thread tensioner in accordance with the invention consist in its wholly built-in construction, in its control by a special knob and in the fact of its combination with the whole thread guideway. These advantages are obtained if the thread tensioner is characterized in that the device for the production of a mutual pressure between a pair of pressure plates by means of a spring consists of a regulator placed separately from the thread tensioner plates, which regulator is connected to the spring by means of a link, and that the plates are combined with a hook or a clasp on each side of the plates in the thread guideway through the thread tensioner device.

BRIEF DESCRIPTION OF THE DRAWINGS

A means for the assembling of a sewing machine and a sewing machine including a presser foot and needle bar unit as well as a thread tensioner device according to the invention are described in the following with reference to the enclosed drawing, which shows in FIG. 1 illustrates a ready-assembled sewing machine into the fully-opened rear of the body.

DETAILED DESCRIPTION OF THE EMBODIMENTS

Figure 4:
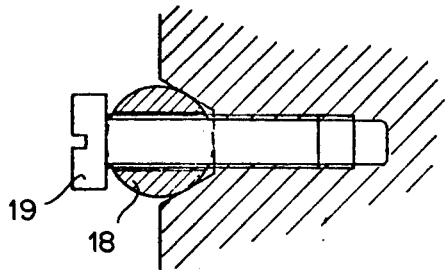
FIGS. 4–7 show, on an enlarged scale, variants of points of attachment for fixed shafts and bars in prepared seats in the body.

The sewing machine shown comprises parts which are largely known from conventional designs of sewing machines. It differs, however, from conventional machines in that different mechanisms are assembled to larger units. These units in the machine shown constitute the following: a presser and needle bar unit 1, a thread tension unit 2, a top shaft unit 3, a stitch length unit 4, a zigzag control 5 together with bottom arm shafts and a shuttle mechanism. The assembly of the machine takes place in stages. Thus, regulator wheels 6 are fitted on the frontside of the machine with mounting in a front wall 7 of the body. These regulators comprise cams, gears, pins etc. which thus emerge on the inside, farthest-in in the open body. The units are assembled and adjusted in their position later, in turn, and in the order starting with the units situated farthest-in in the body, that is to say, according to the embodiment shown, the thread tension unit 2 and the stitch length unit 4. The first named has an angle plate (hidden in the figure) and a control plate 8, which are both fixed by means of screws and a pin 9 with a spring tension plate in prepared points of attachment in the front wall 7 of the body. The stitch length unit has a fixed shaft 10, which is attached, according to the variant in FIG. 4 in a seat 11 in the body.

Figure 2:
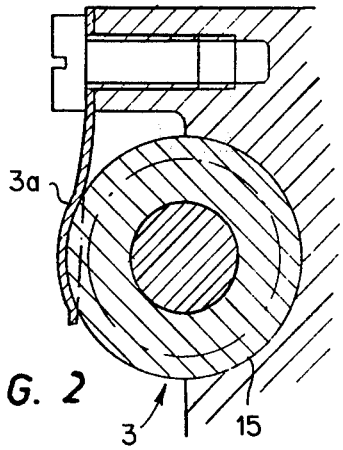
FIG. 2 is an enlarged section on line 2—2 of FIG. 1 showing a point of attachment for a bearing in a seat.
Figure 3:
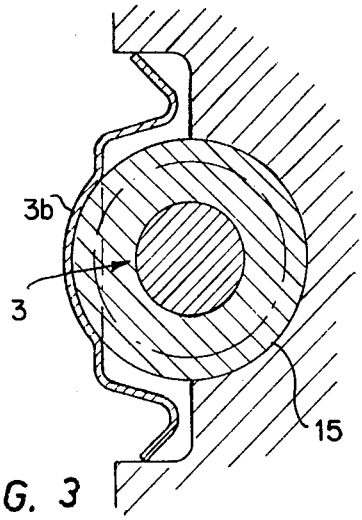
FIG. 3 is an enlarged section on line 3—3 of FIG. 1 showing a variant of such a point of attachment.

The top shaft unit 3, provided with a hand wheel 12, belt drive 13, bushings 14, gears, eccentrics, cranks etc. is fitted in its bearing seat 15 by means of clamps *3a, 3b* respectively, according to a variant of point of attachment in FIG. 2 of FIG. 3.

Figure 9:
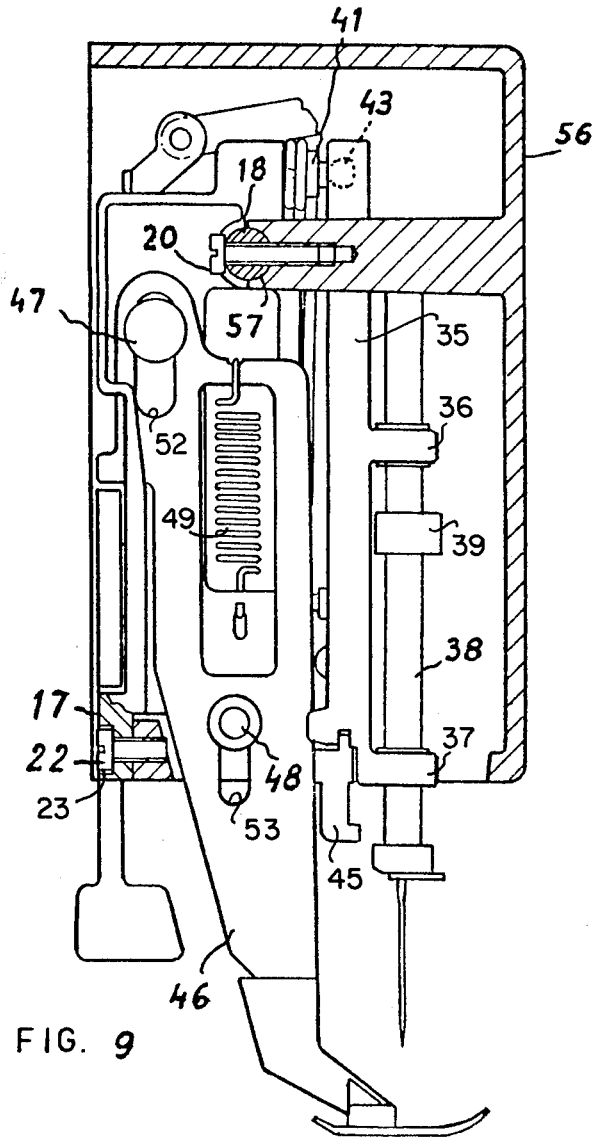
FIG. 9 illustrates, on an enlarged scale, the same unit as in FIG. 8, shown from the side, mounted in the machine and taken on line 9—9 of FIG. 1.

The unit 1 built-up around the needle bar and presser foot mechanism includes a frame 16, which has a fixing lug 17 and a bar 18 passing through a hole 18*a*. The unit has three points of attachment 19, 20, 21, the first two of which correspond to variants according to FIG. 4. In the lower part, the frame is held to the body by means of a screw 22 which passes through an oblong hole 23 in the lug 17 (FIG. 9). The unit is assembled and is dismantled from crank 40 of the top arm shaft by a displacement of the unit on the bar 18 before the screw 22 is drawn up, whereby a pin (concealed in FIG. 1) fixed to and guided by the needle bar entering into the mechanism is pushed into or drawn out of a bushing in the crank mechanism which drives the needle bar.

Figure 6:
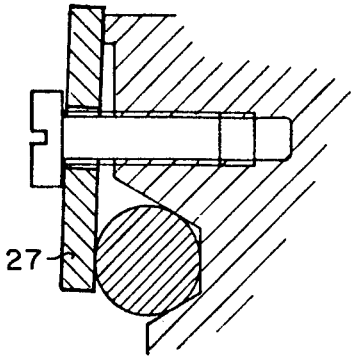
Figure 5:
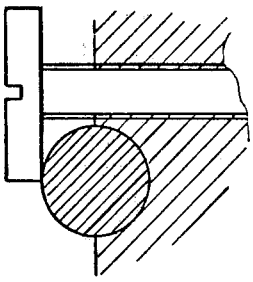
Figure 7:
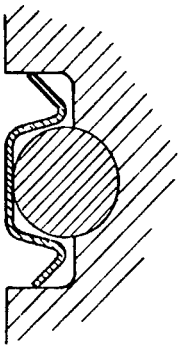

The zigzag control 5 is placed in a post or column 24 of the body and is fixed thereto by means of two fixed shafts 25, 26 entering into the unit. The upper ends, which are in the form of pins, are introduced into holes in the top of the body, and the lower ends are fitted in points of attachment 27, 28 similar to those shown in FIG. 6.

Bottom arm shafts 28, 29, 30 are fitted in respective seats in the body. The shuttle driving shaft is provided with belt drives 31, 32, bearing bushings and gears, and is fitted in accordance with any one of the attachments shown in FIG. 2 and FIG. 3. The feed shaft 29 has, besides bearing bushings, a lever arm at each end, which transmits the feed movement from a fork 33, connected to the stitch length unit, to a material feeder 34. Finally, the tilting shaft 30, which transmits the up and down movement of the feeder 34 from an eccentric on the top shaft, is attached similarly to the shaft 29 in the seat according to FIGS. 2 or 3.

Figure 1:
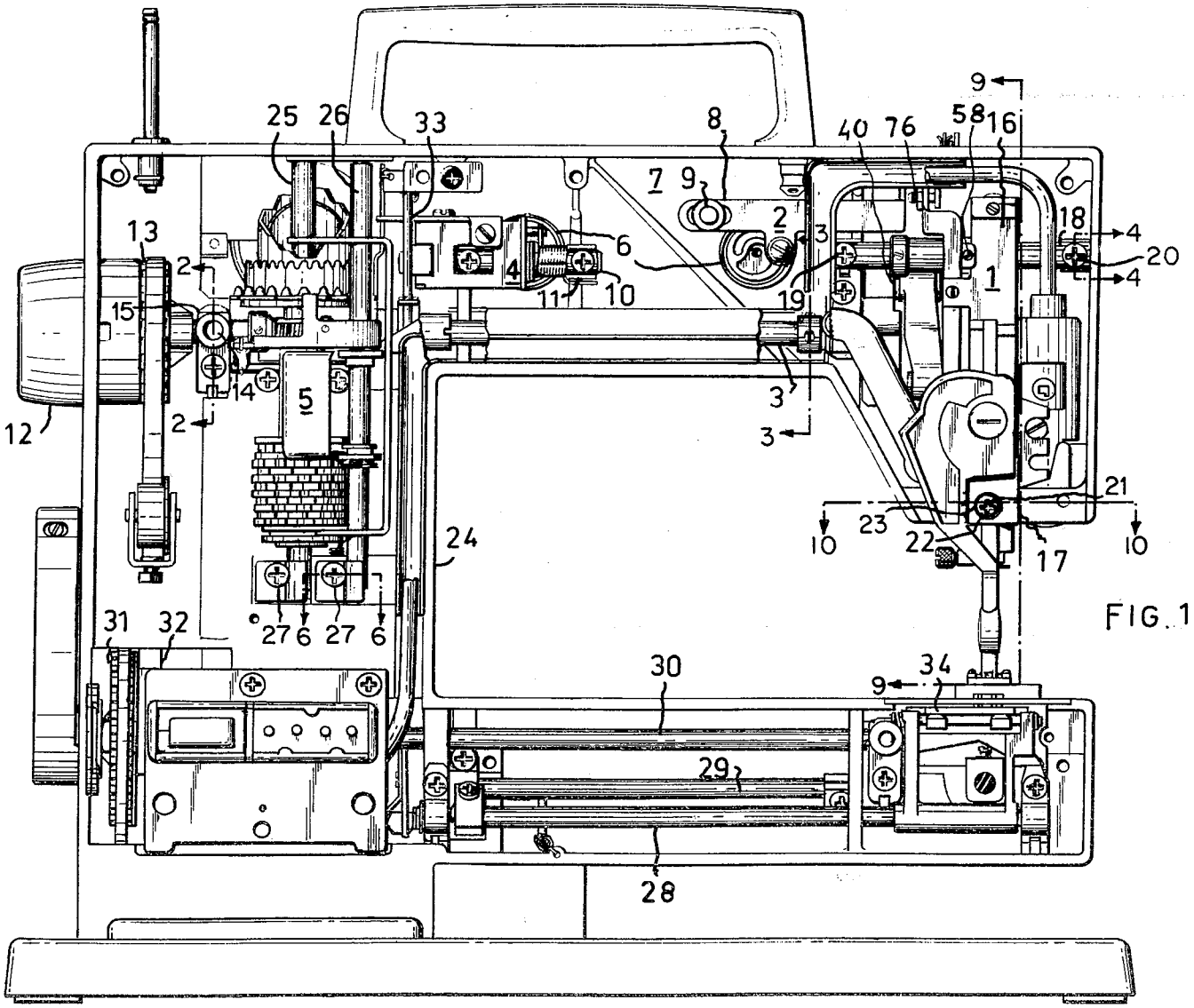

The unit built up around the needle bar and presser foot mechanism includes the frame 16, which has the fixing lug 17 and a bar 18 passing through the hole 18*a*. The needle bar mechanism is defined by a needle bar holder 35 together with spaced bearings 36, 37 for a needle bar 38 movable in a vertical direction, and a connecting link 39 leading to the crank 40 (FIG. 1). The holder 35 has a bearing 41 in the top of the frame 1, in which a screw 42 is screwed into the frame and provided with a ball 43 (FIG. 8) to act as a bearing. Due to the screw 42 being adjustable, and capable of being locked in certain positions, it is possible to set a distance between the holder 35 and the frame 1 at this end. The needle bar holder is pivotable sideways in the bearing 41 and is controlled in its lower end by a guide rib 44, co-operating with a cam 45 on the frame.

The presser foot mechanism is defined by a plate 46 mounted on two upper and lower pins 47, 48 in the frame, a helical spring 49 by which the plate is urged downwardly and a lever arm 50 mounted on a screw 51 in the frame 1. The pin 47 is fixed by means of a screw which passes through the frame and is screwed into an eccentric hole (not shown) in the pin 47. By such means the position of the pin 47 can be somewhat adjusted and can be fixed in a certain position with the help of the screw. The plate has oblong holes 52, 53, in which slide the pins when the plate is shifted vertically in the frame. It is acted upon in a downward direction by the spring 49, which brings about the pressure of the presser foot. Furthermore, the plate has a projection 54 which rests against a curved portion 55 on the lever arm 50. The slope of the curve causes the plate 46 to be lifted against the action of the spring 49, when the lever arm 50 is swivelled about the screw 51 from the vertical position shown to a horizontal position.

The placing of the assembled unit in a top arm 56 of the sewing machine is shown in FIG. 9. The unit has a so-called three-point mounting, indicated by the three screws 19, 20, 22 (FIG. 1). The bar 18 passing through the frame 16, which also forms the bearing shaft for a thread take-up 77, is placed in cast seats 57 in the top arm 56 and is held therein by the screws 19, 20. In the lower part, the frame is held to the top arm by means of the screw 22, which passes through the oblong hold 23 in the lug 17.

Figure 8:
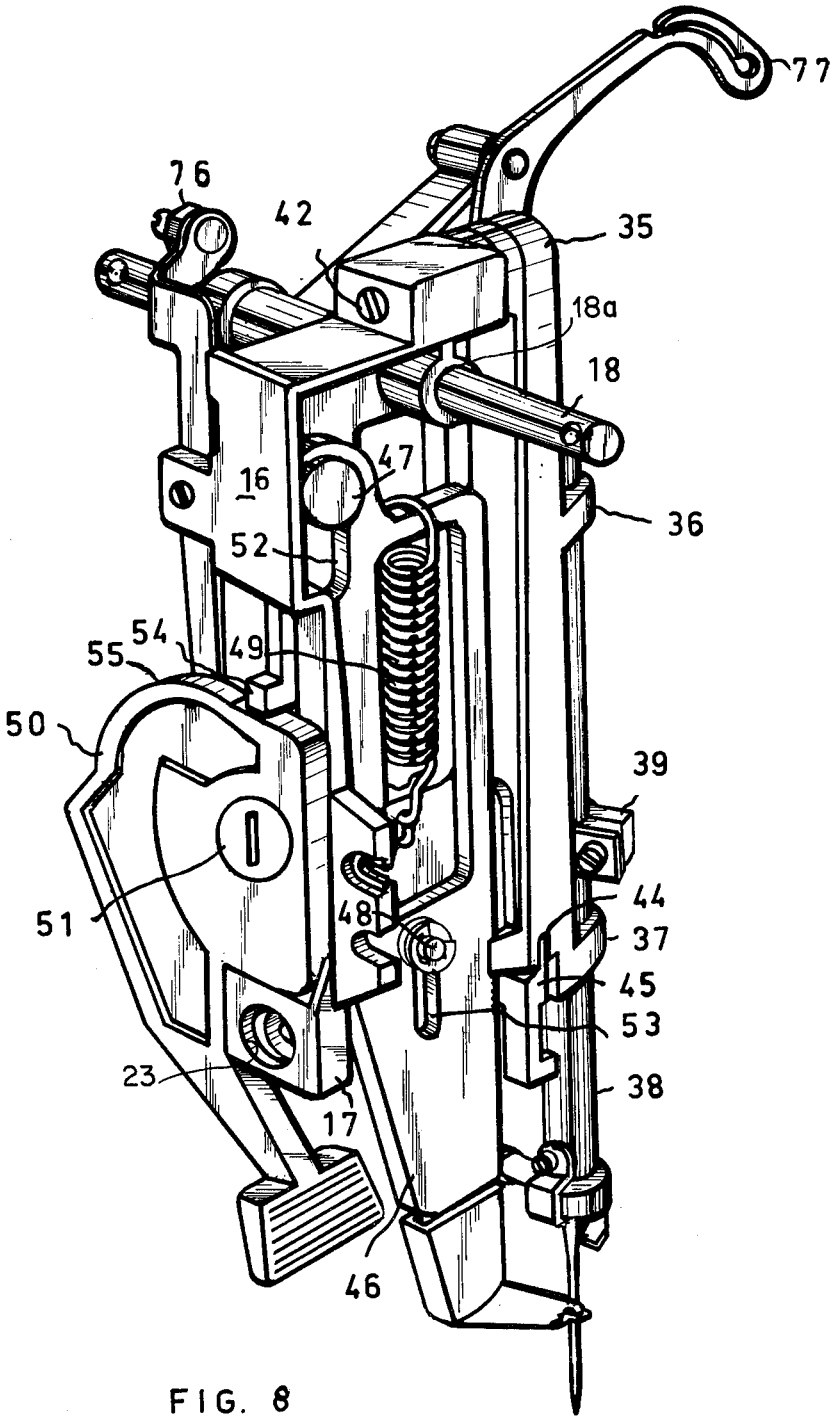
FIG. 8 shows on an enlarged scale, a presser foot and needle bar unit in perspective.

The needle bar 38 and the presser foot plate 46 are adjusted in the length direction of the top arm 56 in relation to the hook and stitch plate of the machine in that the frame 16 is shifted on the bar 18 to the right or to the left in FIG. 8. The position is locked by means of a stop screw 58 and the screw 22 respectively (FIG. 1).

The adjustment of the needle bar and the presser foot in the direction of feed of the machine, that is to say to the right or left in FIG. 9, is carried out with the help, as previously described, of the screw 42 and the eccentrically tightened pin 47.

The unit is assembled or dismantled from the crank 40 of the arm shaft by a shifting of the unit on the bar 18, whereby a pin fixed and guided on the needle arm is pushed into or drawn out of a bushing in the crank mechanism which drives the needle bar.

Figure 10:
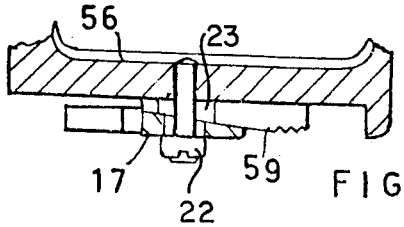
FIG. 10 shows a section on line 10—10 of FIG. 1 at an alternative point of attachment of the unit FIGS. 8 and 9.

A somewhat different mode of attachment for the lug 17 is shown in the alternative embodiment in FIG. 10. In this embodiment the adjustments of the needle bar and the presser foot in the direction of feed have been combined to an adjustment which is carried out by means of a wedge 59 between the fixing lug 17 and the top arm 56. The needle bar holder and the presser foot plate have then been assembled in the predetermined position in the frame on, for example, a fixed ball 43 or pin 47 respectively. Alternatively, of course, any one of the adjustment possibilities on the ball or on the pin may be retained.

The thread tension device 2 includes a frame 60 which has a flange 61 which is attached to the inside of the sewing machine body. At its upper end, the frame forms a holder for a pair of spring tension plates 62, 63 and a plain plate 64 therebetween which are all threaded onto a shaft 65 fixed in the frame 60. The braking force is produced by a pressure rod 66 and a helical spring 67 which, via a release arm 68, presses the plates against the frame. The pressure rod has an oblong hole 69, through which passes a fixing and control pin 9 and a curve follower 70. An adjusting knob 71 is mounted in a hole on front 72 of the machine body and has an inner end formed as a spiral curve 73, into which projects the curve follower 70. When the knob is turned, the follower slides on the curve and displaces the rod in its longitudinal direction. The spring force is influenced by the position of the rod and the thread tension, which is determined by the pressure against the plates 62, 63, can thus be continuously varied with the help of the knob 71, whose position can be read off on a scale 74.

The spring force against the discs can be released by swivelling the release arm 68 about a support 75 formed by a lip on the frame 60. The arm is swivelled towards the right in FIG. 1 by the effect of an outer lever arm 76, included in the mechanism for the operation of the pressure 46.

Figures 11, 12, 13:
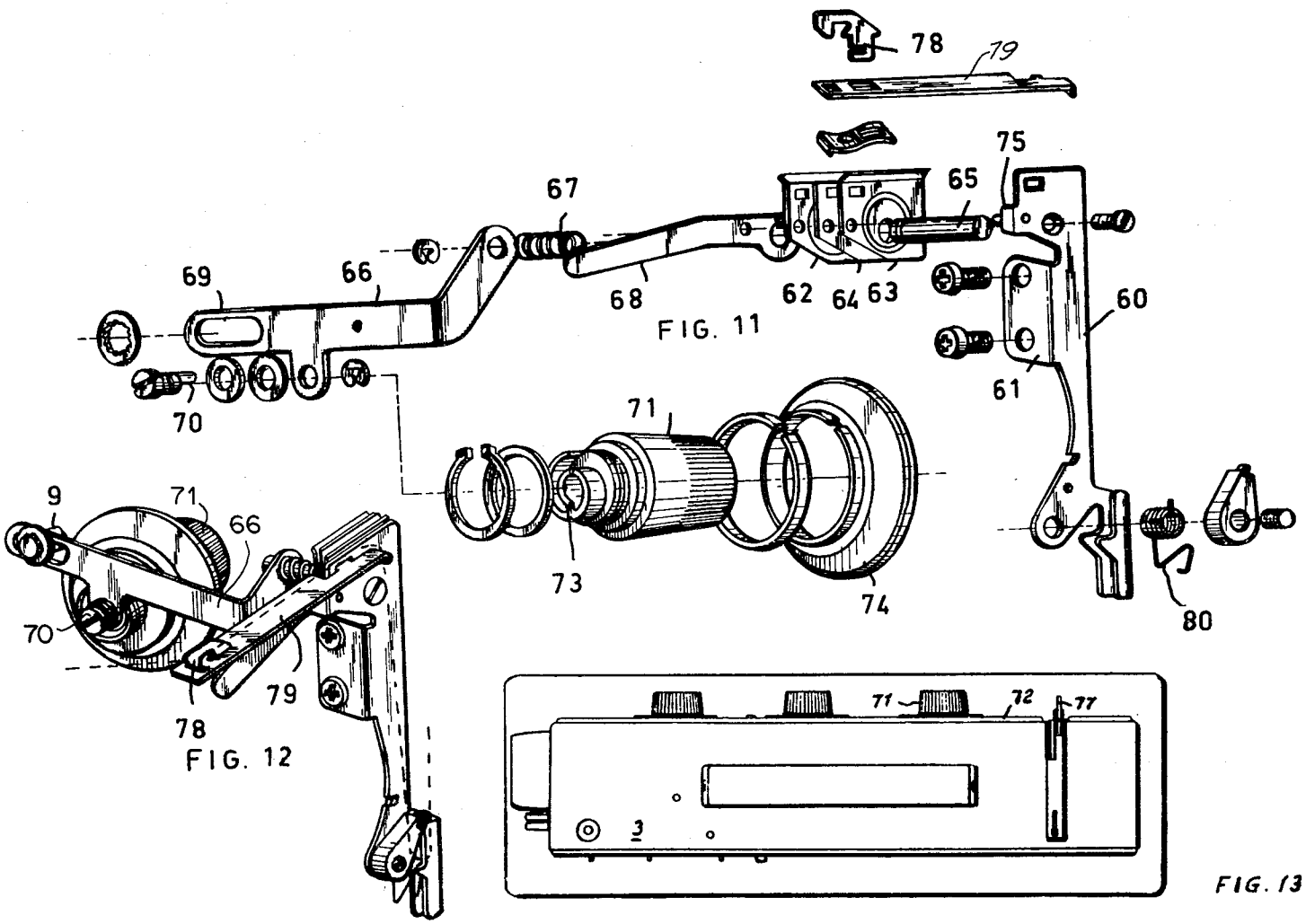
FIG. 11 is an exploded view of the component parts of the thread tension device.
FIG. 12 shows the assembled thread tension device of FIG. 11.
FIG. 13 is a top view of the sewing machine according to the invention.

The device shown is built up as a unit, which also forms the basis for the thread guidance from a thread spool to the thread take-up lever 77 of the machine. The thread guidance is shown by a broken line in FIG. 12. The thread first passes a hook 78 which is fixed in the upper side of the machine body above a plate strip 79, then goes through the plates 62, 63 and forms a loop around a clasp with a thread delivery spring 80 in the lower end of the frame 20. The unit shown thus includes a great number of different details between which the thread is guided in a certain way, very close to the body of the machine.

The embodiments described are intended as examples of how the invention can be realized. Variants of regulating elements, transfer links and releases may conceivably replace the details described in the foregoing, without departing from the basic idea of the invention. The scope of the invention as a whole is defined in the following patent claims.

What is claimed is:

1. A sewing machine including a body having an open rear portion, an arm, precast seats in the body, a presser foot and needle bar unit, a thread tension device and a top shaft unit, means fastening said unit and device in said seats in the body, the presser foot and needle bar unit being provided with a presser foot mechanism and a needle bar holder, and being defined by an elongated frame having ends, points of attachment at both ends, said points of attachment comprising means providing a range of adjustment for setting of the position of the presser foot and needle bar unit in the arm in at least one direction at a right angle to the longitudinal direction of the elongated frame.

2. The sewing machine according to claim 1, in which said last-mentioned means includes a through bar in one end of the elongated frame, said bar being fixed with its ends in the arm in the longitudinal direction of the arm, with the elongated frame being displaceable on this bar.

3. The sewing machine according to claim 2, in which said last-mentioned means includes a screw attachment in the other end of the elongated frame in the arm which is displaceable in the longitudinal direction of the arm.

4. The sewing machine according to clame 2, in which said last-mentioned means includes a screw pin fixed in the frame and adjustable in relation to the frame, and a bearing point in the upper end of the needle bar holder on the screw pin.

5. The sewing machine according to claim 1, in which said thread tension device comprising a pair of thread tensioner plates, a regulator placed separately from the thread tensioner plates, a spring producing a mutual pressure between said plates, a link connecting the regulator to the spring, the plates being combined with a hook on each side of the plates in the thread tensioner, a frame in which said plates are assembled, a pivotable arm mounted on the frame, and a lower arm for the operation of the presser foot, one end of said arm being under the end of said spring facing towards the plates and the other end being operatively connected to the lever arm.

* * * * *